United States Patent [19]

Haase

[11] 3,964,977

[45] June 22, 1976

[54] METHOD AND APPARATUS FOR OPERATING A LEVELING DEVICE FOR A COKING OVEN

[75] Inventor: Dietrich Haase, Mayen, Germany

[73] Assignee: Hartung, Kuhn & Co. Maschinenfabrik GmbH, Dusseldorf, Germany

[22] Filed: Nov. 5, 1975

[21] Appl. No.: 629,078

[52] U.S. Cl. ..... 201/40; 202/263; 214/23

[51] Int. Cl.[2] ..... C10B 37/04

[58] Field of Search ..... 201/40; 202/262, 263; 34/242; 432/64; 214/23

[56] References Cited

UNITED STATES PATENTS

| | | | |
|---|---|---|---|
| 2,268,316 | 12/1941 | Taylor | 214/23 |
| 2,290,568 | 7/1942 | McIntosh | 214/23 |
| 2,819,889 | 1/1958 | Dany | 432/64 |
| 3,386,365 | 6/1968 | Jensen | 432/64 X |
| 3,821,088 | 6/1974 | Barron | 201/40 X |

FOREIGN PATENTS OR APPLICATIONS

| | | | |
|---|---|---|---|
| 1,161,561 | 9/1958 | France | |
| 482,881 | 4/1928 | Germany | 201/40 |

*Primary Examiner*—Morris O. Wolk
*Assistant Examiner*—Arnold Turk
*Attorney, Agent, or Firm*—Michael J. Striker

[57] ABSTRACT

An end wall of a horizontally extending coking chamber is provided with an opening through which a reciprocatable leveling rod projects with clearance into the chamber for leveling coal fed thereinto. Channel means communicating at one end with this opening surround with clearance the portion of the leveling rod outside the chamber. Air under pressure is fed into the region of the outer end of the channel means and sucked out from the latter from the region of the one end to thereby prevent gas to pass through the clearance between the rod, the opening in the wall and the channel means to the outside of the coking oven without feeding any of the air into the chamber.

12 Claims, 3 Drawing Figures

METHOD AND APPARATUS FOR OPERATING A LEVELING DEVICE FOR A COKING OVEN

BACKGROUND OF THE INVENTION

The present invention relates to a method for operating a leveling device for leveling coal fed in a coking oven, in which a leveling rod passing through an opening provided in an end wall of a horizontally extending chamber of the coking oven is surrounded outside the oven by channel means which communicate at one end with the opening in the end wall of the chamber and into which air under pressure is fed from the other end thereof, and an apparatus for carrying out the method.

The French Pat. No. 1,161,561 discloses an arrangement in which at least one nozzle is arranged in the opening of the end wall of a chamber of a coking oven through which the leveling rod extends in order to blow steam into the chamber. This method, however, of blowing steam, respectively air, through the opening in the end wall into the chamber has not led to satisfying results and therefore has not been used in practice. The reason therefore may reside in the excessive loading of the conduit discharging distillation gases from the chamber, respectively in explosions which may result from the air blown into the oven chamber.

SUMMARY OF THE INVENTION

It is an object of the present invention to provide a method and apparatus which will prevent discharge of gases developing in the chamber of a coking oven through the opening in an end wall thereof through which the leveling rod extends, and which avoids the disadvantages of such methods and apparatus as known in the art.

With these and other objects in view, which will become apparent as the description proceeds, the method according to the present invention of operating a leveling rod for leveling coal in a horizontally extending coking chamber with clearance through an opening in an end wall of the coking chamber into the latter and with a portion thereof outside the chamber with clearance through a protecting channel communicating at one end thereof with the opening, mainly comprises the steps of reciprocating the leveling rod, feeding air under pressure into the other end of the channel, sucking air from the region of the one end of the channel out of the latter, and adjusting the relationship between the air fed into and air sucked out from the channel so that the amount of air fed into the other end of the channel, at any internal pressure in the chamber, and preferably at the lowest pressure in the chamber, is equal to the amount of air sucked from the region of the one end of the channel, to thereby prevent passage of gas from the interior of the chamber through the opening and the channel to the outside of the coking oven without feeding any of the air into the chamber.

According to a further advantageous feature of this method, the sucking of air from the region of the one end of the channel is carried out by a suction pump connected to suction openings provided in this regions and in which the suction pressure between the suction pump and the aforementioned suction openings is throttled in such a manner that the pressure difference between these suction openings and the suction pump is a multiple of the maximum pressure variations in the chamber.

In this way, relatively small amounts of air which are blown at high speed by a blower toward the opening in the wall of the chamber can be sucked from the region of this opening, whereby the throttling of the sucked off air can be adjusted to the smallest overpressure in the chamber, that is eventually also to a negative pressure, to thereby assure that gas from the interior of the chamber at relatively high pressure in the latter will not be sucked out of the chamber by the suction pump. By means of the medium under pressure, an enclosed space is thus provided outside the opening in the wall of the chamber in which the pressure under formation of an air cushion automatically increases with the increase of pressure in the chamber. Only a relatively small amount of air, respectively gas, can in this arrangement escape through the relatively small opening of the throttle in the suction arrangement. This will, however, not essentially influence the function of the aforementioned enclosed space. In this enclosed space, a pressure will be built up according to the pressure in the interior of the coking chamber so that no essential pressure difference between the interior of the coking chamber and the aforementioned space in front of the opening will exist and therefore no gas or only a very small amount of gas will pass through the opening in the wall of the chamber through which the leveling rod extends to the outside of the coking chamber.

The leveling device for leveling coal fed into a horizontally extending coking chamber of a coking oven mainly comprises wall means forming a coking chamber and being formed in an end wall thereof with an opening, a reciprocatable leveling rod extending with clearance through the opening in the chamber and having a portion located outside the chamber, channel means surrounding this portion of the leveling rod with clearance and communicating at one end thereof with the aforementioned opening, means for feeding air under pressure in the region of the other end of the channel means into the region of the other end of the channel means into the latter, suction openings provided in the region of the one end of the channel means, and suction means connected to the suction openings for sucking air out of the channel means so that air flows through the clearance between the portion of the leveling rod and the channel means from the other to the one end of the latter thereby preventing gas from the interior of the chamber to pass through the clearance to the outside of the chamber without feeding any of the air into the latter.

The means for feeding air under pressure into the other end of the channel means preferably comprise a blower and the suction means are preferably formed by a suction pump which is designed for a greater throughput of air than the blower. A relatively simple construction is derived when the suction pump and the blower are driven from the same prime mover with the same number of revolutions per time unit.

It is advantageous to arrange in the suction conduit between the suction openings and the suction pump a throttle, which is preferably adjustable in order to assure a sufficiently large pressure drop between the suction openings and the suction pump so that even if the pressure in the coking chamber is increased, a sufficiently large counterpressure is maintained in the aforementioned channel means which will assure a proper sealing of the opening in the end wall of the chamber. In order to compensate for all variations of the pressure in the coking chamber, the pressure difference between the suction openings in the channel means and the suction pump is preferably a multiple of the largest pressure variations in the interior of the chamber during the leveling operation. If, for instance, the pressure in the coking chamber during the leveling operation rises about 20 mm water column, then a pressure difference between the suction openings in the channel means and the suction pump of about 100 mm water column will be sufficient in order to prevent any substantial escape of gas from the interior of the coking chamber through the opening in the wall through which the leveling rod extends.

The means for feeding air under pressure into the other end of the channel means preferably comprises a plurality of nozzles arranged about the portion of the leveling rod within the channel means and directed towards the one end of the latter and a blower connected to the plurality of nozzles. The construction and arrangement of the nozzles in the interior of the channel means is selected according to the necessary amount of air to be blown toward the wall opening. A compact, space saving and nevertheless efficient arrangement can be obtained if the nozzles are arranged in a plurality of groups spaced in longitudinal direction of the channel means from each other in which the nozzles in each group are arranged about the inner surface of the channel means. In this way, a plurality of nozzle rings spaced in longitudinal direction of the channel means are provided, in which the nozzles are provided with circular or slot-shaped outlet openings and with the axes of the individual nozzles preferably arranged inclined to the axis of the leveling rod.

If the leveling rod comprises a pair of parallel side webs and a plurality of transverse webs extending uniformly spaced from each other between the side webs, then the distance between the one end of the channel means and the nozzles nearest to this one end is preferably chosen greater than the spacing between any two adjacent transverse webs. This will assure that the amount of air which can escape through the end of the channel means which is opposite the opening in the wall of the coking chamber will be relatively small.

It is further advantageous to provide upstream of the nozzles in the channel means an uninterrupted channel position portion, the length of which corresponds at least to the distance between two adjacent transverse webs of the leveling rod. This will, further improve the seal of the clearance between the leveling rod and the wall of the channel means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
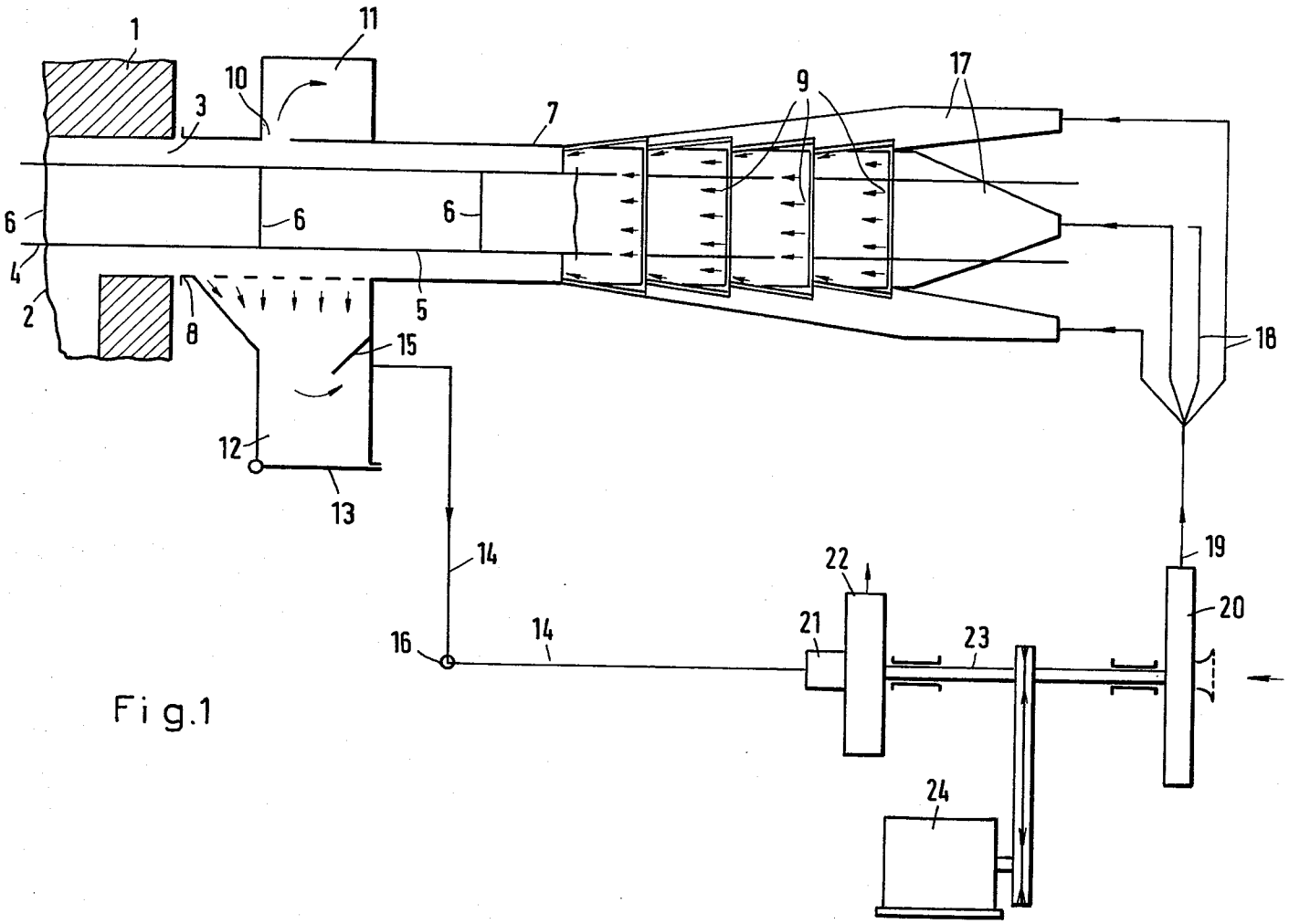
FIG. 1 is a schematic illustration of the apparatus according to the present invention.

FIG. 1 schematically illustrates part of a coking oven 1 with a coking chamber 2. It is to be understood that a plurality of coking chambers is arranged in a row one behind the other and these coking chambers have to be at intevals, after coke has been discharged therefrom, charged with coal which through an opening in the ceiling of the chamber. In order to level the pile of coal, an end wall of the coking chamber 2 is provided with an opening 3 for the passage of a leveling rod 4 into the chamber. The leveling rod 4 usually comprises two parallel side webs 5 connected to each other by a plurality of transverse webs 6 extending normal to the side webs uniformly spaced from each other. By reciprocating the level rod 4, by means well known in the art and not illustrated in the drawing, a pile of coal in the chamber 2 is leveled by means of the transverse webs 6. After such leveling is accomplished, the leveling rod 4 is withdrawn through the opening 3 and moved transverse to its longitudinal direction to the next coking chamber for leveling the coal fed thereinto.

In order to properly seal the opening 3 through which the leveling rod 4 extends during the leveling operation, protective channel means 7 are provided surrounding at least a portion of the leveling rod 4 extending outside of the chamber 2 and abutting with its end 8 against the end wall of the coking oven around the opening 3 therein.

A plurality of blowing nozzles 9, as indicated by the arrows shown in FIG. 1 is arranged in a plurality of groups in a portion of the channel means 7 distant from the end 8 thereof. Each of the nozzle groups extend around the inner circumference of the channel means 7. The blowing nozzles 9 are arranged to blow air into the clearance between the leveling rod 4 and the inner surface of the channel means 7 in the direction toward the opening 3. This will provide for an air seal which will prevent escape of gas and flames from the interior of the coking chamber 2 through the opening 3 to the outside of the coking oven.

As clearly shown in FIG. 1, the distance between the blowing nozzles 9 nearest to the opening 3 and the end 8 of the channel means is greater than the distance between two adjacent transverse webs 6 of the leveling rod 4. In this way, the free cross section in the channel means 7 and therewith also that in the opening 3 at each position of the leveling rod 4 during its reciprocation, is always reduced by the surface of one transverse web 6, even when the leveling rod 4 has a position in which the opening 3 is arranged, as shown in FIG. 1, between two adjacent transverse webs 6 and therefore substantially completely open.

A plurality of suction openings 10, preferably distributed about the circumference of the channel means 7, is arranged closely adjacent to the end 8 thereof and the suction openings 10 communicate with an annular manifold 11 surrounding this portion of the channel means 7. The lower part of the annular manifold 11 is enlarged to a container 12 communicating with the interior of the channel means 7, in which coal pieces, withdrawn from the chamber 2 during reciprocation of the leveling rod 4 by the transverse webs 6, may be collected. The lower end of the container 12 is closable by a lid 13, which during the leveling operation is closed.

A suction conduit 14 communicates with the interior of the container 12 substantially midway between the upper and the lower end of the latter. The inlet end of the suction conduit 12 is protected by an inclined plate 15, arranged as shown in FIG. 1. A throttle 16, which is preferably adjustable, is arranged in the suction conduit 14.

The blow nozzles 9 are connected by means of a manifold 17 and conduits 18 to the outlet end of a blower 20 which, according to FIG. 1, is constructed as a radial flow compressor. The necessary air is sucked into the blower 20 as indicated by the arrow in FIG. 1, from the air surrounding the blower. The suction conduit 14 is connected to the suction socket 21 of a suction pump 22 which, according to FIG. 1, is likewise constructed as a radial blower. The suction pump 22 and the blower 20 are arranged on a common shaft 23, which, over a belt drive, is driven from a motor 24.

The blower 20 and the suction pump 22 are thereby driven with the same number of revolutions per time unit. The suction pump 22 is constructed for a greater throughput of air than the blower 20, whereby through the throttle 16 in the suction conduit 14 and through the pressure loss resulting from the coal collected in the container 12, a sufficiently large counterpressure will be maintained by the air sucked through the suction opening 10 in the region of the end 8 of the channel means 7 which will prevent substantial escape of gases from the interior of the chamber 2 through the opening 3. The throttling points in the suction conduit 14 compensate for any pressure variations in the coking chamber 2 and the opening 3. The amount of gas which will enter into the channel means 7 and be sucked out from the latter by the suction pump 22 will therefore be small even if the pressure in the opening 3 should rise. In order to prevent, without expensive regulating means, entrance of blowing air through the opening 3 into the coking chamber 2 during all operating conditions of the coking oven, the suction pump 10 and the blower 20 are so dimensioned that during the minimum pressure occurring in the opening 3, the total amount of air blown into the channel means 7 by the nozzles 9 will be sucked out from the region adjacent the end 8 of the channel means. Since the suction pump 22 and the blower 20 are driven with the same number of revolutions per time unit, the relationship between the air blown into and the air sucked out of the channel means will remain also constant during other operating conditions.

Figure 2:
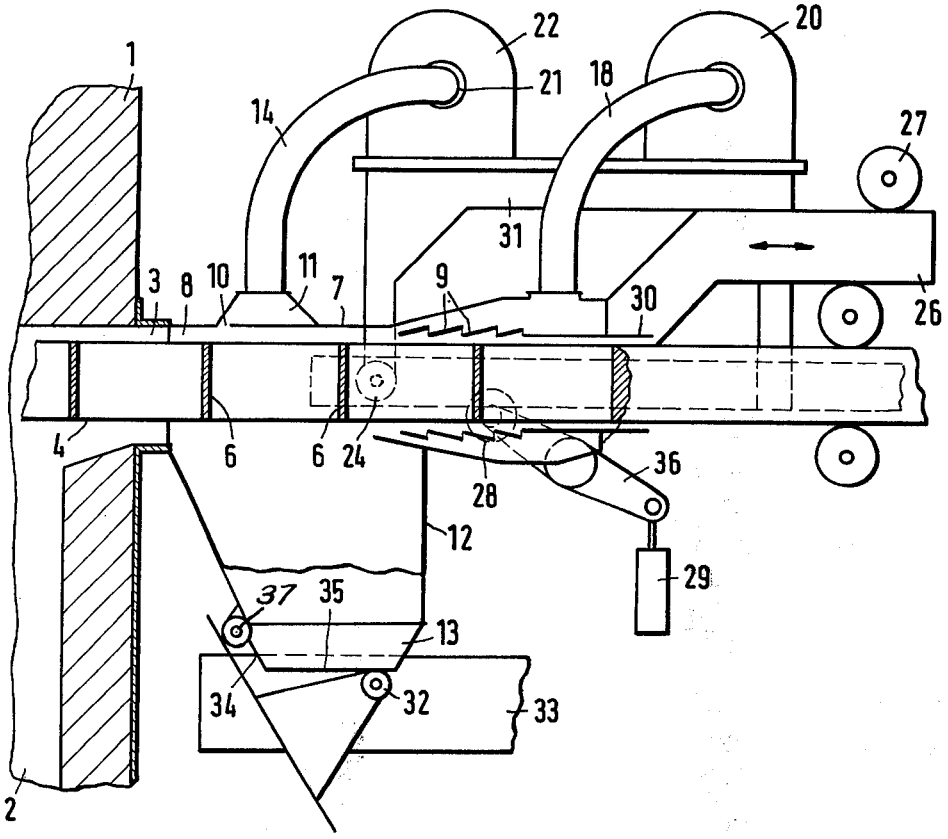
FIG. 2 is a vertical cross section through a preferred arrangement according to the present invention.
Figure 3:
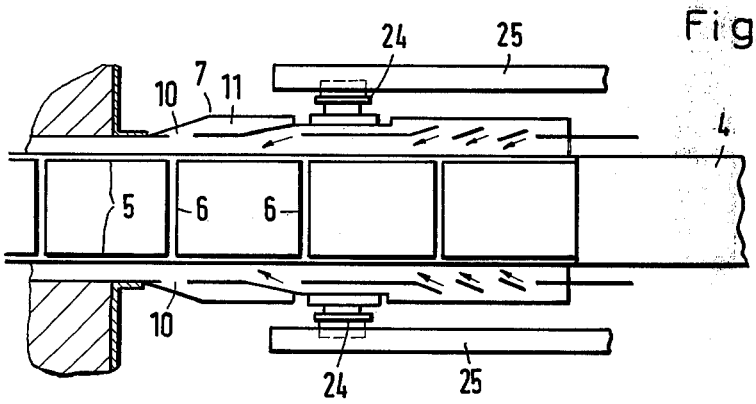
FIG. 3 is a top view of the embodiment shown in FIG. 2, partially sectioned.

The channel means 7 in the embodiment shown in FIGS. 2 and 3 are movable relative to the coking oven 1 by means of non-illustrated hydraulic motors. For this purpose, the channel means 7 are supported substantially in the middle thereof by rollers 24 arranged on stationary rails 25 as well as by an arm 26 on its rear end which engages with its upper surface a supporting roller 27. In addition, a tiltable lever 36 pivotally mounted in the region of the outer end of the channel means 7 carries on its forward end a roller 28 abutting against the rail 25, whereas the rear end of the lever 36 carries a counterweight 29.

The rear end portion, or right end portion, of the channel means 7, as viewed in FIG. 2, is constructed as a non-interrupted portion 30, the length of which is at least equal to the distance between two adjacent cross webs 6 of the leveling rod 4. Thereby, any blowing air escaping through the rear end of the channel means 7 is held very small during each position of the leveling rod 4, respectively the cross webs 6. In each position of the leveling rod 4 duriing the reciprocation thereof at least one cross web 6 will be located within the channel portion 30 so that the cross webs 6 of the leveling rod 4 will contribute to the sealing of the channel means 7.

The blower 20 and the suction pump 22 are mounted on a stationary support 31. In order to permit movement of the channel means 7 and the stationary support 31 relative to each other during movement of the end 8 of the channel means into abutment with the end wall of the coking oven, respectively during the withdrawl of the channels means 7, the suction conduit 14 and the blow conduit 18 are constructed as flexible hoses.

The lower side of the lid 13 for the container 12 is constructed as control curve, as shown in FIG. 2, for the opening and the closing of the lower end of the container 12. The control curve has a substantially horizontal portion 35 and an upwardly inclined portion 34. The lid 13 is connected to the lower end of the container 12 by a hinge 37 for tilting movement about the hinge axis. In the active position of the channel means 7 as shown in FIG. 2, the horizontal portion 35 of the control curve at the lower end of the lid 13 abuts against a roller 32 which is turnably mounted on a stationary support 33. During movement of the channel means 7 towards the right as viewed in FIG. 2, the upwardly inclined portion 34 of the control curve will be moved into engagement with the roller 32 so that the lid 13 will tilt about the axis of the hinge 37 to the open position by gravity and due to the weight of the coal in the container 12 resting on the lid.

The amount of air which has to be blown into the channel means 7 will be influenced also by the spacing between two adjacent transverse webs 6. The amount of necessary blowing air can be reduced by reducing the distance between adjacent cross webs 6. Evidently it is also possible to combine the suction pump 22 and the blower 20 into a single unit.

It will be understood that each of the elements described above, or two or more together, may also find a useful application in other types of method and apparatus differing from the types described above.

While the invention has been illustrated and described as embodied in a method and apparatus for operating a leveling device for leveling coal in a coking oven, it is not intended to be limited to the details shown, since various modifications and structural changes may be made without deparing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of operating a leveling rod for leveling coal in a horizontally extending coking chamber of the coking oven, in which the rod passes with clearance through an opening in an end wall of the coking chamber into the latter and with a portion thereof outside the chamber with clearance through a channel, said channel having two ends and communicating at one end thereof with said opening, said method comprising the steps of reciprocating the leveling rod; feeding air under pressure into the other end of said channel; sucking air from the region of said one end of the channel out of the latter; and adjusting the relationship between the air fed into and sucked out from the channel so that the amount of air fed into the other end of said channel, at any internal pressure in said chamber, is equal to the amount of air sucked from the region of said one end of said channel to thereby prevent passage of gases from the interior of the chamber through said opening and said channel to the outside of the coking oven, without feeding any of the air into the chamber.

2. A method as defined in claim 1, wherein the pressure in the chamber varies, wherein the sucking of air from said region of said one end of said channel is carried out by a suction pump connected to suction openings provided in said region in a wall forming said channel and including the step of throttling the suction pressure between said suction pump and said suction openings in order that the pressure difference between said suction openings and said suction pump is a multiple of the maximum pressure variations in said chamber.

3. A leveling device for leveling coal in a horizontally extending chamber of a coking oven, comprising wall means forming a coking chamber, said wall means including an end wall having an opening therein; a reciprocable leveling rod extending with clearance through said opening into said chamber and having a portion located outside said chamber; channel means surrounding said portion of said leveling rod with clearance, said channel means having two ends and communicating at one end thereof with said opening; means for feeding air under pressure into the region of the other end of said channel means into the latter; suction openings provided in the region of said one end of said channel means; and suction means connected to said suction openings for sucking air out of said channel means so that air flows through said clearance between said portion of said leveling rod and said channel means from said other to said one end of the latter thereby preventing gas from passing through said clearance between said opening and the leveling rod to the outside of said chamber, without feeding any of the air into the latter.

4. A leveling device as defined in claim 3, wherein said means for feeding air under pressure into said other end of said channel means comprises a blower and wherein said suction means is a suction pump, said suction pump being constructed for a greater throughput of air than said blower.

5. A leveling device as defined in claim 4, and including means for driving said suction pump and said blower with the same number of revolutions per time unit.

6. A leveling device as defined in claim 4, and including conduit means between said suction openings and said suction pump and a throttle located in said conduit means.

7. A leveling device as defined in claim 6, wherein said throttle is adjustable.

8. A leveling device as defined in claim 5, wherein said means for feeding air under pressure into said other end of said channel means comprises a plurality of nozzles arranged about said portion of said leveling rod within said channel means and directed towards said one end of the latter and a blower connected to said plurality of nozzles.

9. A leveling defined in claim 8, wherein said leveling rod comprises a pair of parallel side webs and a plurality of transverse webs extending uniformly spaced from each other between said side webs, and wherein the distance between said one end of said channel means and the nozzles nearest to said one end is greater than the spacing between any two adjacent transverse webs.

10. A leveling device as defined in claim 9, wherein said nozzles are arranged in a plurality of groups spaced from each other in the longitudinal direction of said channel means.

11. A leveling device as defined in claim 8, wherein each of said nozzles has an axis inclined toward the axis of said leveling rod.

12. A leveling device as defined in claim 8, wherein said channel means has at the other end thereof and upstream of the nozzles, as considered in the direction of the air flowing therethrough, an uninterrupted portion of length which is greater than the distance between two adjacent transverse webs.

* * * * *